US006550990B2

(12) United States Patent
Sakurai et al.

(10) Patent No.: US 6,550,990 B2
(45) Date of Patent: Apr. 22, 2003

(54) SUBSTRATE PROCESSING APPARATUS AND PROCESSING METHOD BY USE OF THE APPARATUS

(75) Inventors: Hideaki Sakurai, Yokohama (JP); Masamitsu Itoh, Yokohama (JP); Shinichi Ito, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/022,637

(22) Filed: Dec. 20, 2001

(65) Prior Publication Data

US 2002/0081118 A1 Jun. 27, 2002

(30) Foreign Application Priority Data

Dec. 21, 2000 (JP) ..... 2000-388357
Sep. 28, 2001 (JP) ..... 2001-304016

(51) Int. Cl.[7] ..... G03D 5/00
(52) U.S. Cl. ..... 396/604; 396/611; 396/627; 118/52
(58) Field of Search ..... 396/604, 611, 396/627; 134/153, 902; 118/52, 319–321

(56) References Cited

U.S. PATENT DOCUMENTS

| | | | | |
|---|---|---|---|---|
| 5,815,762 A | * | 9/1998 | Sakai et al. | 396/611 |
| 5,965,200 A | | 10/1999 | Tateyama et al. | 396/611 |
| 5,976,256 A | * | 11/1999 | Kawano | 118/684 |
| 6,092,937 A | * | 7/2000 | Snodgrass et al. | 396/611 |

FOREIGN PATENT DOCUMENTS

| | | | |
|---|---|---|---|
| JP | 7-36195 | | 2/1995 |
| JP | 10-92784 | | 4/1998 |
| JP | 10-156255 | | 6/1998 |
| JP | 11-80967 | * | 3/1999 |
| JP | 11-340192 | | 12/1999 |
| JP | 2000-15159 | | 1/2000 |
| JP | 2000-79366 | | 3/2000 |
| TW | 353199 | | 2/1999 |

OTHER PUBLICATIONS

Ito, S. et al., "Substrate–Treating Device and Method of Treating Substrate Using the Same", U.S. Ser. No.: 09/553,480, Filed: Apr. 20, 2000, Specification—84 pages, and 15 sheets of drawings.

Nakamura, H. et al., "Substrate Processing Method and Apparatus", U.S. Ser. No.: 09/840,111, Filed: Apr. 24, 2001, Specification—51 pages, and 11 sheets of drawings.

Nakamura, H. et al., "Substrate Processing Method and Apparatus", U.S. Ser. No.: 09/255,659, Filed: Feb. 23, 1999, Specification—51 pages, and 11 sheets of drawings.

Taiwan Office Action dated Oct. 23, 2002, and English translation thereof.

* cited by examiner

*Primary Examiner*—D Rutledge
(74) *Attorney, Agent, or Firm*—Finnegan, Henderson, Farabow, Garrett & Dunner, L.L.P.

(57) ABSTRACT

An apparatus for processing a substrate comprising a substrate holding mechanism for holding the substrate substantially horizontally, a chemical solution discharge/suction mechanism having a chemical solution discharge/suction portion which has a chemical solution outlet for discharging a chemical solution onto the substrate and chemical solution inlets for sucking up the chemical solution present on the substrate, and a chemical solution supply/suction system for supplying the chemical solution to the chemical solution discharge/suction mechanism simultaneously with sucking the chemical solution by the chemical solution supply/suction mechanism.

23 Claims, 6 Drawing Sheets

SUBSTRATE PROCESSING APPARATUS AND PROCESSING METHOD BY USE OF THE APPARATUS

CROSS-REFERENCE TO RELATED APPLICATIONS

This application is based upon and claims the benefit of priority from the prior Japanese Patent Applications No. 2000-388357, filed Dec. 21, 2000; and No. 2001-304016, filed Sep. 28, 2001, the entire contents of both of which are incorporated herein by reference.

BACKGROUND OF THE INVENTION

1. Field of the Invention

The present invention relates to a substrate processing apparatus and a substrate processing method for use in the steps of manufacturing semiconductor devices, photomasks, liquid crystal displays, etc. The present invention particularly relates to a developing apparatus and a developing method by use of the developing apparatus for developing a substrate coated with a photoresist and exposed to light via a predetermined pattern.

2. Description of the Related Art

In the steps of manufacturing semiconductor devices and liquid crystal displays, a photoetching process is repeatedly applied to a substrate. In the photoetching process, a photoresist is applied to a substrate, and the photoresist-coated substrate is exposed to light via a predetermined pattern. The pattern-exposed substrate is developed by a developing solution in a developing apparatus to thereby remove the photoresist of, for example, the parts exposed to light.

In the developing step thus performed, a dip method in which a substrate is treated while being immersed in a developing solution, a spray method in which a substrate is treated by spraying a developing solution on the surface to be treated (hereinafter, sometimes referred to as a "treatment-receipt surface"), and a paddle method in which a substrate is treated by supplying a developing solution to the treatment-receipt surface while rotating.

However, the dip method and the spray method have problems. They require a large amount of developing solution and much cost for treating waster water. Therefore, they have been replaced by the paddle method. The paddle method, however, has a problem of nonuniform development. This is because the discharge pressure and the supply amount of the developing solution per unit area differ between the center of the substrate and the periphery.

Under the circumstances, a scan method as shown in Japanese Patent Application No. 7-36195 (hereinafter, referred to as "Prior Art") has hitherto been developed. In the scan method, a developing solution is supplied to the treatment-receipt surface by moving a nozzle supplying the developing solution in a scanning manner, and then, developing is performed by the developing solution supplied onto the substrate.

Recently, in the field of semiconductors, with the progress of miniaturization and high integration of semiconductor devices, the demand for miniaturizing semiconductor devices in the photoetching step has increased. At present, the design rule of devices has reached a level of 0.13 $\mu$m. The dimensions of a pattern are required to be controlled with an extremely high accuracy of about 10 nm.

However, the conventional scan-development mentioned above is accompanied by such a problem that the pattern size finally obtained differs from the predetermined pattern size due to uneven density of the pattern. More specifically, in the conventional scan-development, although a developing solution is supplied to the treatment-receipt surface of a substrate in a scanning manner, the developing solution supplied to the substrate as a liquid-mountain (globule) is rarely replaced with a fresh one. Therefore, the amount of the product resulting from the developing solution reacting with the resist differs between a densely patterned portion and a non-densely patterned portion, with the result that the concentration of the developing solution differs between both portions. Due to the uneven density of the pattern, a pattern cannot be obtained with high accuracy.

As described above, the developing solution supplied onto the treatment-receipt surface is rarely replaced in conventional scan development. Because of this, particularly in the case of a pattern with an uneven density, the concentration of the developing solution locally changes during the developing process. As a result, the pattern size varies depending upon the uneven density of the pattern. Hence, the pattern cannot be obtained with high accuracy.

BRIEF SUMMARY OF THE INVENTION

According to an aspect of the present invention, there is provided an apparatus for processing a substrate comprising

- a substrate holding mechanism for holding the substrate substantially horizontally;
- a chemical solution discharge/suction mechanism having a chemical solution discharge/suction portion which has a chemical solution outlet for discharging a chemical solution onto the substrate and chemical solution inlets for sucking up the chemical solution present on the substrate; and
- a chemical solution supply/suction system for supplying the chemical solution to the chemical solution discharge/suction mechanism simultaneously with sucking the chemical solution by the chemical solution supply/suction mechanism.

According to another aspect of the present invention, there is provided an apparatus for processing a substrate comprising:

- a substrate holding mechanism for holding the substrate substantially horizontally;
- a chemical solution discharge/suction mechanism having a chemical solution discharge/suction portion in which at least two chemical solution outlets for discharging a chemical solution onto the substrate and at least two chemical solution inlets for sucking up the chemical solution present on the substrate are arranged alternately; and
- a chemical solution supply/suction system for supplying the chemical solution to the chemical solution discharge/suction mechanism simultaneously with sucking the chemical solution by the chemical solution supply/suction mechanism.

According to another aspect of the present invention, there is provided a substrate processing method for processing a surface of a substrate with a chemical solution comprising:

- discharging the chemical solution onto the substrate whose surface to be treated is horizontally held, continuously through a chemical solution outlet of a chemical solution discharge/suction portion; and
- simultaneously sucking up the chemical solution on the surface to be treated continuously through a chemical solution inlet arranged next to the chemical solution outlet in the chemical solution discharge/suction portion, while the chemical solution discharge/suction portion is horizontally moved relative to the substrate, in which a fresh chemical solution is always supplied to a gap between the chemical solution discharge/suction portion and the substrate and in the region between the chemical solution outlet and the chemical solution inlet.

According to another aspect of the present invention, there is provided a substrate processing method for processing a surface of a substrate to be treated with a chemical solution comprising:

arranging a chemical solution discharge/suction portion having at least two chemical solution outlets for discharging the chemical solution and at least two chemical solution inlets alternately arranged, on the substrate whose surface to be treated is held substantially horizontally;

discharging the chemical solution continuously onto the substrate to be treated from the chemical solution outlets; and simultaneously sucking up the chemical solution on the surface to be treated continuously through the chemical solution inlets, while horizontally moving the chemical solution discharge/suction portion relative to the substrate, thereby treating the surface to be treated with the chemical solution, in which a fresh chemical solution is always supplied to a gap between the chemical solution discharge/suction portion and the substrate and in the region between each of the chemical solution outlets and each of the chemical solution inlets.

DETAILED DESCRIPTION OF THE INVENTION

Now, embodiments of the present invention will be explained with reference to the accompanying drawings.

The embodiments described below will show an example in which the present invention is applied to a developing apparatus and a developing method.

First Embodiment

Figure 1A:
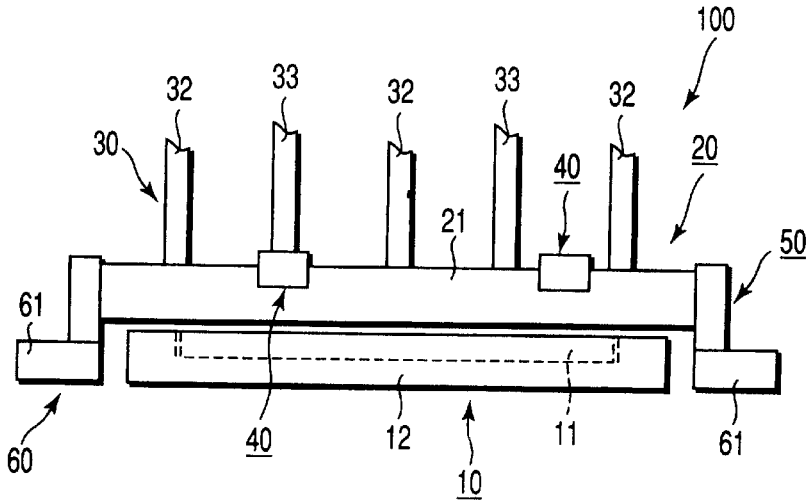
FIG. 1A is a front view of a developing apparatus according to an embodiment of the present invention as viewed from the front relative to the moving direction of the apparatus.
Figure 1B:
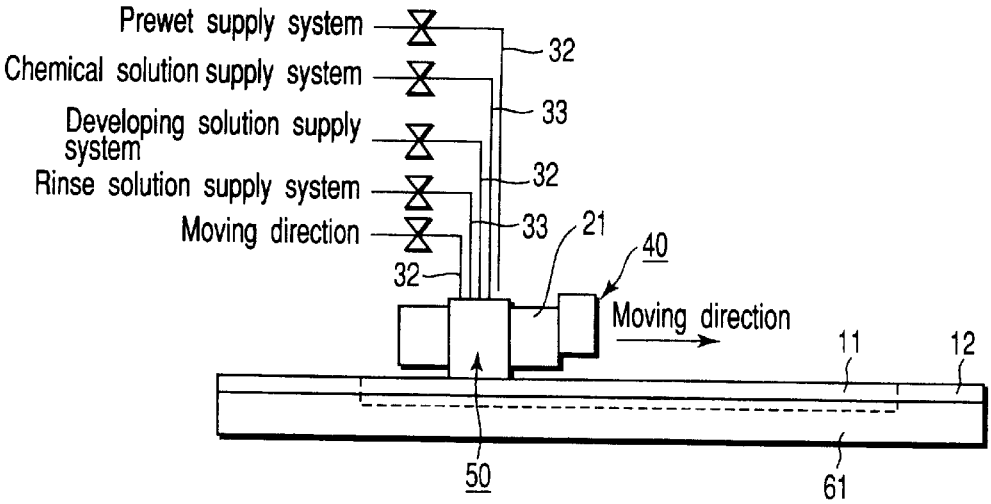
FIG. 1B is a side view of the developing apparatus according to the embodiment.
Figure 2:
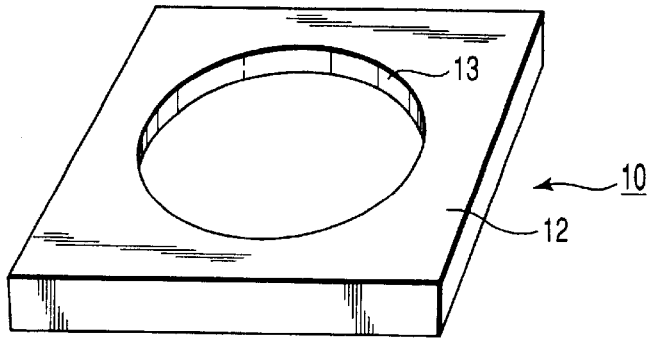
FIG. 2 is a perspective view showing a substrate holder of the developing apparatus of the embodiment.

The developing apparatus and the developing method using the same according to an embodiment of the present invention. FIG. 1A is a front view of the developing apparatus, as viewed from the front relative to the moving direction of the apparatus. FIG. 1B is a side view of the apparatus as viewed from the sideward relative to the moving direction. FIG. 2 is a perspective view showing a substrate holder of the developing apparatus.

In this embodiment, as shown in FIGS. 1A and 1B, the developing apparatus 100 has a substrate 11, a substrate holding mechanism 10 for holding, for example, a semiconductor wafer substantially horizontally, a chemical solution discharge/suction mechanism 20 arranged above the substrate holding mechanism 10, a chemical solution supply/suction system 30 for supplying a chemical solution to the chemical solution discharge/suction mechanism 20 and sucking up the chemical solution from the chemical solution discharge/suction mechanism 20, a gap measuring mechanism 40 attached to the chemical solution discharge/suction mechanism 20, a gap adjusting mechanism 50 attached to both ends of the chemical solution discharge/suction mechanism 20; and a moving mechanism 60 for moving the chemical solution discharge/suction mechanism 20 relative to the substrate holding mechanism 10 substantially in the horizontal direction.

The substrate holding mechanism 10 has a substrate holder 12 of a flat plate of 35 cm square, which has a depressed portion 13 in the upper surface for housing a semiconductor wafer 11 as shown in FIG. 2. The depressed portion 13 has a flat structure having substantially the same size as that of the semi-conductor wafer 11 and substantially the same depth as the thickness of the wafer 11.

As the substrate holder 12, it is preferred to select a material such that the surface of the holder formed of the material has the same wettability as that of the substrate surface. More specifically, the material for the substrate holder is appropriately chosen such that a developing solution is in contact with the substrate holder at the same angle as that of the substrate.

The chemical solution discharge/suction mechanism 20 has a chemical solution discharge/suction portion (hereinafter referred to as a scan nozzle) 21.

Figure 3A:
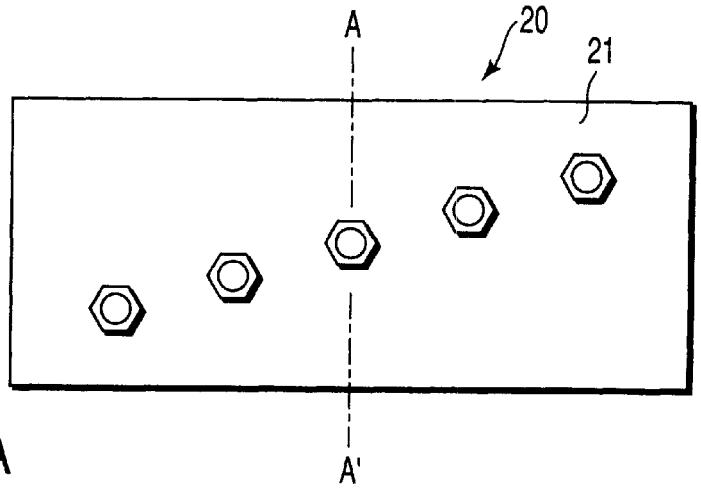
FIG. 3A is a top view (viewed from above) of a scan nozzle of the developing apparatus according to the embodiment.
Figure 3B:
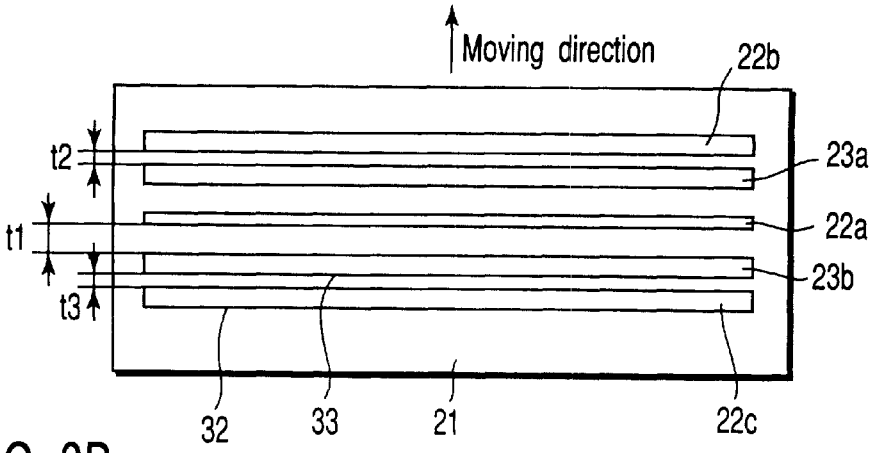
FIG. 3B is an underside view (viewed from the bottom) of the scan nozzle of the developing apparatus according to the embodiment.
Figure 3C:
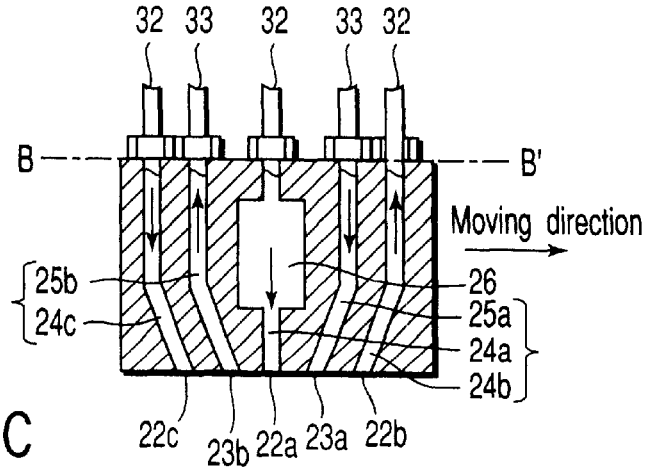
FIG. 3C is a sectional view taken along the line A–A' of FIG. 3A.
Figure 3D:
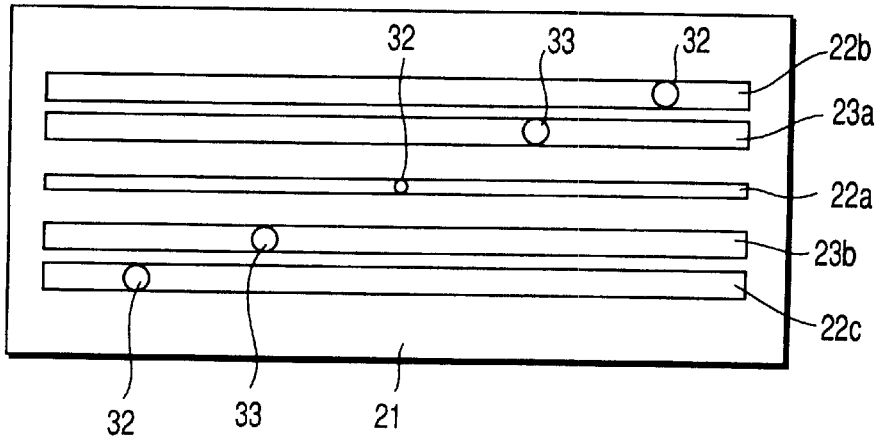
FIG. 3D is a sectional view taken along the line B–B' of FIG. 3C.

The detailed structure of the scan nozzle is shown in FIGS. 3A to 3D. The FIG. 3A is a top view of the scan nozzle. FIG. 3B is an underside view of the scan nozzle. FIG. 3C is a sectional view taken along the line A–A' of FIG. 3A. FIG. 3D is a sectional view taken along the line B–B' of FIG. 3D.

As shown in FIGS. 3A to 3D, the scan nozzle 21 has a columnar structure having a rectangular cross-section whose long side is perpendicular to the moving direction of the substrate holder 12 and short side is in parallel to the moving direction. The lower surface of the scan nozzle 21 facing the substrate holder 12 has a flat surface. The long side has a length which is at least equal to or more than the width of the substrate holder 12.

In the scan nozzle 21 of the embodiment, the length of the long side is set at about 35 cm and the length of the short side is set at about 5 cm.

In the lower surface of the scan nozzle 21, a chemical solution outlet 22 of a slit form for supplying the chemical solution to the semiconductor wafer 11 and a chemical solution inlet 23 of a slit form for sucking up the chemical solution mounted on the semiconductor wafer 11.

In this embodiment, the slits of the chemical solution outlet 22 and the chemical solution inlet 23 have a long side in the direction perpendicular to the moving direction of the scan nozzle to the substrate holder 12 and a short side in the direction parallel to the moving direction.

In this embodiment, three chemical solution outlets 22*a*, 22*b* and 22*c* and the chemical solution sucking up ports 23*a* and 23*b* are arranged at predetermined intervals in the direction in parallel to the moving direction of the scan nozzle to the substrate holder 12. In this case, the chemical solution outlet 22*a* in the middle is a first chemical solution outlet for supplying a first chemical solution. The first chemical solution outlet serves as, for example, a developing solution outlet for discharging a developing solution (hereinafter, referred to as "developing solution outlet"). The ports 23*a* and 23*b* arranged on both sides of the port 22*a* are chemical solution inlets. The port 22*b* positioned at the front relative to the moving direction of the scan nozzle is a second chemical solution outlet for supplying a second chemical solution. The second chemical solution outlet serves, for example, as a prewet solution outlet (hereinafter, referred to as a "prewet solution outlet"). The port 22*c* positioned at the back relative to the moving direction is a third chemical solution outlet for supplying a third chemical solution. The third chemical solution supply port serves, for example, a rinse solution outlet (hereinafter, the referred to as a "rinse solution outlet").

The developing solution to be supplied from the developing solution outlet 22*a* is naturally discharged on the substrate by the help of the suction force of the inlets 23*a*, 23*b* positioned on the both sides of the developing solution outlet 22*a*.

The developing solution outlet 22*a* has a length of 310 mm and a width of 1 mm. The chemical solution inlets 23*a* and 23*b*, each has a length of 310 mm and a width of 3 mm. The prewet solution outlet 22*b* and the rinse solution outlet 22*c* each has a length of 310 mm and a width of 3 mm.

The distance t1 between the developing solution outlet 22*a* and each of the chemical solution inlets 23*a* and 23*b* is set at about 5 mm. Both the distance t2 between the prewet solution outlet 22*b* and the chemical solution inlet 23*a* and the distance t3 between the rinse solution outlet 22*c* and the chemical solution inlet 23*b* are set at about 2 mm.

The scan nozzle 21 houses slit nozzles 24*a*, 24*b*, 24*c* and 25*a* and 25*c*, which have the ports 22*a*, 22*b*, 22*c*, 23*a* and 23*b* at the lower ends, respectively. The slit nozzles 24*b*, 24*c*, 25*a*, and 25*c* communicate with a chemical solution supply system and a chemical solution suction system (not shown) by way of a chemical solution supply pipe 32 and a chemical solution suction pipe 33, respectively. The slit nozzle 24*a* connecting to the developing solution outlet 22*a* is connected to the chemical solution supply system (not shown) via a liquid storage 26 for uniformly dispersing the developing solution in the longitudinal direction.

At the side surface of the scan nozzle 20, a gap measuring mechanisms 40 is provided for determining the distance between the lower surface of the scan nozzle 20 and the upper surface of the semiconductor wafer 11 to be mounted on the substrate holder 12, by use of laser light.

The moving mechanism 60 has a scan stage 61. The gas adjusting mechanism 50 is fixed on both end portions of the scan nozzle 21 so as to horizontally move on the scan stage 61 together with the scan nozzle 21.

The gas adjusting mechanism 50 has a piezo element, which adjusts the distance between the lower surface of the scan nozzle 21 and the upper surface of the semiconductor wafer 11 to be mounted on the substrate holder 12 to a predetermined value based on the measurement results given by the gap measurement mechanism.

Now, a developing method by use of the developing apparatus of this embodiment will be explained with reference to FIGS. 4, 5A–5C, 6A–6C.

Figure 4:
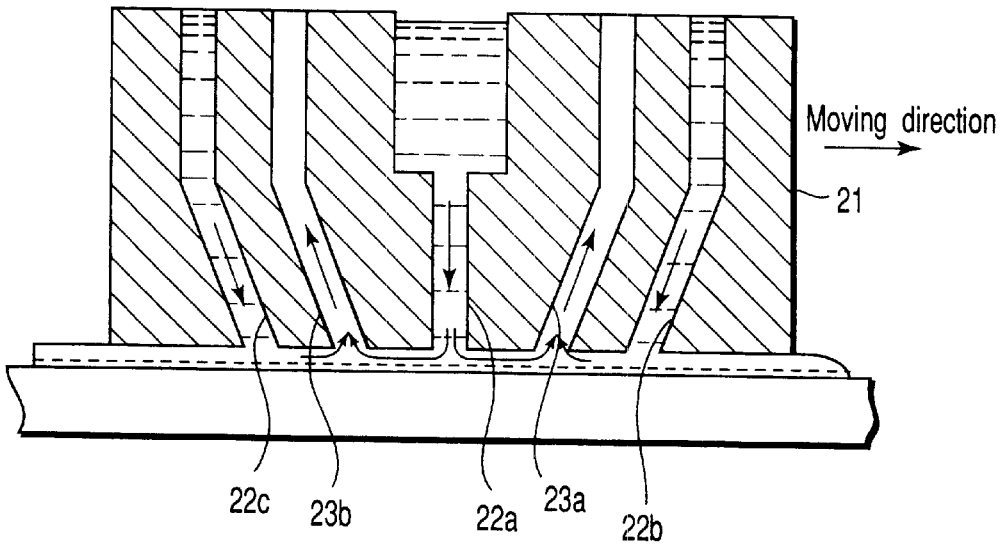
FIG. 4 is a schematic view showing the manner how to discharge or suck a chemical solution to/from a substrate by a scan nozzle in an apparatus according to an embodiment of the present invention.

FIG. 4 is a view schematically showing how to discharge or suck a chemical solution to/from a substrate by the scan nozzle. FIGS. 5A to 5C and FIGS. 6A to 6C are side views and top views, respectively, which schematically show individual steps of a developing process.

In the first place, as shown in FIG. 4, the scan nozzle 21 is arranged in the proximity of the treatment-receipt surface of the substrate 11. A developing solution is discharged from the developing solution outlet 22*a* in the middle, a prewet solution is discharged from the prewet solution outlet 22*b*, and a rinse solution is discharged from the rinse solution outlet 22*c*; at the same time, the chemical solution mounted on the treatment-receipt surface is sucked up by the chemical solution inlets 23*a* and 23*b*. The developing solution flows through a slit between the lower surface of the scan nozzle 21 and the treatment-receipt substrate and in the region between the chemical solution inlets 23*a* and 23*b* which are located on both sides of the developing solution outlet 22*a*. By virtue of this mechanism, a fresh developing solution is always supplied to the region. Upon dissolving a photoresist, the developing solution is immediately sucked up and removed. Thus, a fresh developing solution is always mounted on the aforementioned region.

The prewet solution, when it is discharged onto the treatment-receipt surface, is partly sucked up together with the developing solution by the chemical solution inlet 23*a* near the prewet outlet. However, most of the prewet solution is discharged in the gap between the treatment-receipt surface and the lower surface of the scan nozzle 21 and in the forward to the prewet solution outlet 22*b* in the moving direction. It follows that a prewet treatment, that is, a reforming treatment of the treatment receipt surface is successfully performed. After the reforming treatment, the scan nozzle 21 moves, so that the prewet solution is removed by sucking up through the chemical solution inlet 23*a, b* and simultaneously replaced with the developing solution. On the other hand, the rinse solution discharged from the rinse solution outlet 22*c* is partly sucked up together with the developing solution by the chemical solution inlet 23*b*. However, most of the rinse solution is discharged in the gap between the treatment-receipt surface and the lower surface of the scan nozzle 21 on the backward to the rinse solution outlet 22*c* in the moving direction. As the scan nozzle 21 moves, the developing solution present in the region, which has been used in the development treatment, is gradually sucked up and removed by the chemical solution inlet 23*b*, and simultaneously replaced with the rinse solution discharged from the rinse solution outlet 22*c* and sucked up from the chemical solution inlet 23*b*. The remainder rinse solution is left on the treatment-receipt surface after the scan nozzle 21 is moved, and finally removed by rotation the substrate 11.

Figure 5A:
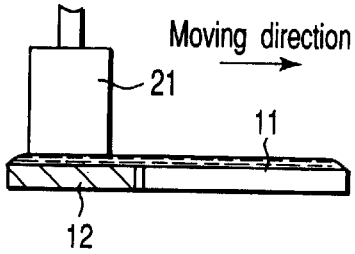
FIGS. 5A to C are side views showing developing processes by a developing apparatus according to an embodiment of the present invention.
Figure 6A:
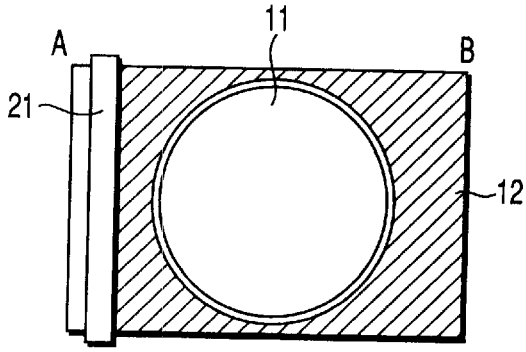
FIGS. 6A to 6C are plan views showing developing processes by a developing apparatus according to an embodiment of the present invention.
Figure 6B:
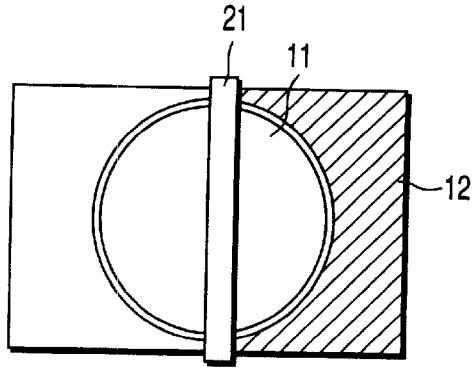

Next, the developing process of the substrate will be explained. In the first place, as shown in FIGS. 5A and 6A, the scan nozzle 21 is positioned on the substrate holder 12 at the left hand side of the substrate 11, the developing solution, the prewet solution, and the rinse solution are discharged on the substrate holder 12 through the developing solution outlet 22*a*, the prewet solution outlet 22*b*, and the rinse solution outlet 22*c*, respectively, and simultaneously the chemical solutions discharged on the substrate holder 12 are sucked up by the chemical solution inlets 23*a* and 23*b*.

In the stage where each flow of the chemical solutions is adjusted on the substrate holder 12, the scan nozzle 21 is started to move along an allow (from the left hand side to the right hand side of the paper). After the scan nozzle 21 is moved on the substrate 11 (FIGS. 5B and 6B), it is further moved up to the substrate holder 12 on the right hand side of the substrate 11.

Figure 5B:
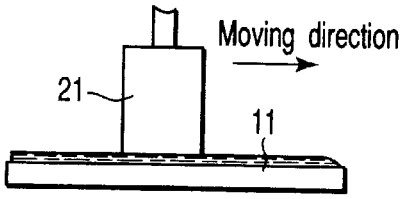
Figure 5C:
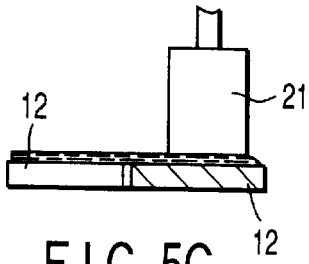
Figure 6C:
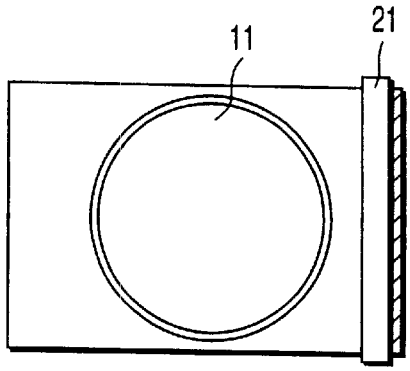

When the rinse solution outlet 22*c* of the scan nozzle 21 passes on the substrate 11 and reaches the substrate holder 12, the discharge of each of the chemical solutions is terminated (FIGS. 5C and 6C).

According to the aforementioned embodiment, a fresh developing solution is always and directly supplied to the surface of the substrate 11 and the used developing solution used is immediately removed by suction. Therefore, the developing solution is present in a uniform concentration on the semiconductor substrate 11. Hence, the substrate thus developed can be obtained in the same size without being affected by the uneven density of the pattern.

Now, an example of development performed by the aforementioned developing apparatus will be described.

FIRST EXAMPLE

In the first place, an anti-reflection film was formed on a disk-form Si wafer of 30 cm diameter and further a chemically amplified photoresist film was formed, which had a sensitivity to light of 193 nm wavelength. Subsequently, light of 193 nm wavelength was selectively exposed to the Si wafer surface via a light-exposure mask. As a result, an acid was generated from the photoresist film. Furthermore, the Si wafer was heated at 140° C. for 60 seconds to disperse the acid. In this manner, a latent image was formed.

The Si wafer 11 was then housed in the depressed portion 13 of the substrate holder 12.

As shown in FIG. 5A, the scan nozzle 21 was arranged on the substrate holder 12 at an interval of about 50 $\mu$m from one end portion A of the substrate holder 12. Subsequently, the developing solution, the prewet solution, and the rinse solution were allowed to discharge onto the substrate holder 12 from the developing solution outlet 22*a*, the prewet solution outlet 22*b*, and the rinse solution outlet 22*c*, respectively. At the same time, the chemical solutions present onto the substrate holder 12 were sucked up from the chemical solution inlets 23*a*, 23*b*. In this way, the flows of the chemical solutions were adjusted.

After the flows of the chemical solutions on the substrate holder 12 were adjusted, the movement of the scan nozzle 21 was started along the arrow (from the left hand side to the right hand side on the paper). The scan nozzle 21 was moved with respect to the Si wafer 11 at a constant speed from one end A to the other end B of the substrate holder 12 to perform development. The moving speed was 11 mm/minute. The interval between the developing solution outlet 22*a* and the chemical solution inlet 23*a* was 5 mm. The developing solution outlet 22*a* was apart from the chemical solution suction port 23*b* at the same interval of 5 mm. In addition, the width of the developing solution outlet 22*a* was 1 mm. From this, the region having the developing solution thereon (between the chemical solution inlets 23*a* and 23*b*) in the gap between the scan nozzle 21 and the surface of the Si wafer 11 (in the direction parallel to the moving direction) resulted in about 11 mm. More specifically, provided that an attention was focused on one point of the Si wafer 11, the developing solution passed in one minute. This means that the developing time was one minute.

When the scan nozzle 21 started developing, the pattern positioned at the center of the Si wafer 11 was developed as follows. Thirteen minutes after the movement of the scan nozzle 21 started, the prewet solution outlet 22*b* passed above the pattern. In this manner, the prewet solution was mounted on the surface of the photoresist.

After 10 seconds, the first chemical solution inlet 23*a* passed above the pattern. At this time, the prewet solution on the photoresist surface was replaced with the developing solution. In this way, the developing of the photoresist was initiated.

After 30 seconds, the developing solution outlet 22*a* passed above the pattern and further a second chemical solution inlet 23*b* passed above the pattern. At this time, the developing solution on the surface of the photoresist was replaced with the rinse solution. The development was performed from the time point when the first chemical solution inlet 23*a* passed above the pattern until the time point when the second chemical solution inlet 23*b* passed above it.

After the scan nozzle 21 passed above the pattern, the rinse solution was only placed on the surface of the Si wafer 11. Finally, the rinse solution was removed by rotating the Si wafer 11. After dry, a desired resist pattern was obtained.

According to the example, the alteration of the size of a final product due to the uneven density of the pattern (accompanying conventional method) can be substantially overcome. To explain more specifically, when the line pattern positioned at the center of the line-and-space pattern (which consists of parallel 5 lines (line width: 100 nm, length: 20 $\mu$m) arranged at the center of a 2 mm square was compared to the size of the same center line pattern not positioned in the square, there was a size difference of about 20 nm in a conventional method. However, in this example, the size difference was 2 nm or less.

Furthermore, in the pattern to be employed in manufacturing a practical device, even if the pattern was formed with extremely a high uneven density, it become possible to control the size with the difference ±3% of a desired value in all patterns within a plane. As a result, the characteristics of the device finally obtained were drastically improved.

Second Embodiment

In the first place, an anti-reflection film was formed on a disk-form Si wafer of 30 cm diameter and further a chemically amplified photoresist film was formed, which had a sensitivity to light of 193 nm wavelength. Subsequently, light of 193 nm wavelength was selectively exposed to the Si wafer surface via a light-exposure mask. As a result, an acid was generated from the photoresist film. Furthermore, the Si wafer was heated at 140° C. for 60 seconds to disperse the acid. In this manner, a latent image was formed.

The Si wafer 11 was then housed in the depressed portion 13 of the substrate holder 12.

As shown in FIG. 5A, the scan nozzle 21 was arranged on the substrate holder 12 at an interval of about 50 μm from one end portion A of the substrate holder 12. Subsequently, the developing solution, the prewet solution, and the rinse solution were allowed to discharge onto the substrate holder 12 from the developing solution outlet 22*a*, the prewet solution outlet 22*b*, and the rinse solution outlet 22*c*, respectively. At the same time, the chemical solutions present onto the substrate holder 12 were sucked up from the chemical solution inlets 23*a*, 23*b*. In this way, the flows of the chemical solutions were adjusted.

After the flows of the chemical solutions on the substrate holder 12 were adjusted, the movement of the scan nozzle 21 was started along the arrow (from the left hand side to the right hand side on the paper). A modified scan nozzle 21 (shown in FIGS. 1A, 1B) was moved with respect to the Si wafer 11 at a constant speed from one end A to the other end B of the substrate holder 12.

In this example, the length of prewet (pure water) scanning plane (the region between the preset outlet 22*b* and the developing solution outlet 22*a*) performed by the scan nozzle 21 was set at 5 mm. The length of the developing solution scanning plane (the region between the developing solution outlet 22*a* and the rinse solution outlet 22*c*) was set at 50 mm. The length of the rinse solution scanning plane (the region between the rinse solution outlet 22*c* and the end of the scan nozzle 21) was set at 10 mm.

Furthermore, provided that the scan nozzle 21 was fixed, the flow rate of each of the chemical solutions was set at 500 mm/sec. These scanning planes were allowed to face the Si wafer surface at an interval of about 200 μm.

A water repellent barrier wall(s) was attached between these scanning planes so as to face the substrate surface at an interval of 100 μm. The moving speed of the scan nozzle 21 was set at 10 mm/sec.

When the development was performed by use of the scan nozzle 21, the pattern present at 20 mm apart from one end A toward the other end B of the substrate holder was developed as follows. Two seconds after the movement of the scan nozzle 21 started, the pure water scanning plane passed above the pattern. By virtue of this, the surface of the wafer was exposed to pure water for 0.5 seconds to render the surface of the resist hydrophilic.

Subsequently, the water left on the resist surface was discharged except for an adsorption layer in accordance with the passage of the water-repellant barrier wall. Thereafter, the developing solution scanning plane passed on the pattern in 5 seconds. In this case, the developing time was about 5 seconds. However, the flow rate of the developing solution was fast, so that the pattern was formed at an extremely high developing speed.

Furthermore, a rinse-solution scanning plane passed on the pattern surface to replace the developing solution with the rinse solution. As a result, the wafer surface was cleaned well.

In this example, the prewet, development, and rinse steps were performed in the same conditions at any portion of the substrate. The uniformity of in-plane processing of the substrate was significantly improved. At this time, the processing of the pattern was performed with an accuracy of ±3% with respect to a desired value. Due to this, the characteristics of a device finally obtained were tremendously improved.

Third Embodiment

An Example in which the developing device of the aforementioned example is applied to manufacturing of a photo mask substrate will be explained.

To a Cr mask coated with a chemically amplified positive resist (500 nm thick), a 1 GDRAM pattern having a line-and-space under a 0.15 μm rule was drawn by an electron beam drawing device at an acceleration voltage of 50 keV. After the pattern was drawn, baking was performed for 15 minutes at 110° C.

Subsequently, a substrate was mounted on the developing apparatus of this embodiment, and the scan nozzle was moved from one end A toward the other end B (opposite to the end A) at a constant speed. The development was performed in this manner. The moving speed was 11 mm/minute. The interval between the developing solution outlet 22*a* and the chemical solution inlet 23*a* was 5 mm. The same interval was present on the other side of the developing solution outlet 22*a*. In addition, the width of the developing solution outlet 22*a* was 1 mm. From this, the region having the developing solution thereon (between the chemical solution inlets 23*a* and 23*b*) in the gap between the scan nozzle 21 and the surface of the Si wafer 11 resulted in about 11 mm in the direction parallel to the moving direction. More specifically, provided that an attention was focused on one point of the Si wafer 11, the developing solution passed in one minute. This means that the developing time was one minute.

Subsequently, the substrate was taken out from the developing apparatus and the Cr film was subjected to reactive ion etching using a resist pattern as an etching mask. The apparatus used in the etching was MEPS-6025 manufactured by Alback. As an etching gas, a gas mixture of chloride gas and oxygen gas was used. Thereafter, the resist was removed by an ashing apparatus and cleaned by a washing machine.

The Cr pattern size thus formed was measured by a size measurement device (LWM manufactured by Leica). As a result, the difference between the average size and the desired size of the Cr pattern was 5 nm and the in-plane uniformity of the Cr pattern was 10 nm (3σ).

Then, as an experiment for demonstrating the efficiency of the present invention, a wafer was exposed to light via a commercially available mask by a KrF scanner manufactured by Nikon Co., Ltd. Thereafter, light-exposure tolerance was evaluated. The evaluation was performed by measuring the dimensions of the resist pattern formed on the wafer by means of SEM while varying the defocus amount and the light exposure amount. As a result, when the dimensions of the resist pattern formed on the wafer changed in an amount of 10% or less, the defocus tolerance was 0.45 μm. In this case, the light exposure tolerance was 12%.

In this example, the rinse solution-scanning plane may be divided into a plurality of portions depending upon the rinse solutions to be used. To explain more specifically, when ozone water and a hydrogen peroxide solution are sequentially employed as a rinse solution, the rinse solution scanning plane may be formed of an ozone water scanning plane, a water-repellant wall, and a hydrogen peroxide solution scanning plane. The scanning plane region and the flow amount of the nozzle may be set appropriately depending upon the processing time.

It is not necessary to set the flow amounts of individual chemical solutions at the same values as shown in this example and may be set independently. The flow amounts may be appropriately changed depending upon the ability (performance) of the water-repellant wall for separating chemical solutions. The flow velocity and nozzle moving speed may be varied at any time depending upon the RPT (Raw process time) required.

The wall material between the scanning planes is not limited to the water repellant wall. Any material may be used as the wall as long as adjacent liquids are not mutually mixed or as long as, even if mixed, desired characteristics of individual liquids adjacent to each other can be obtained.

Fourth Embodiment

Figure 7:
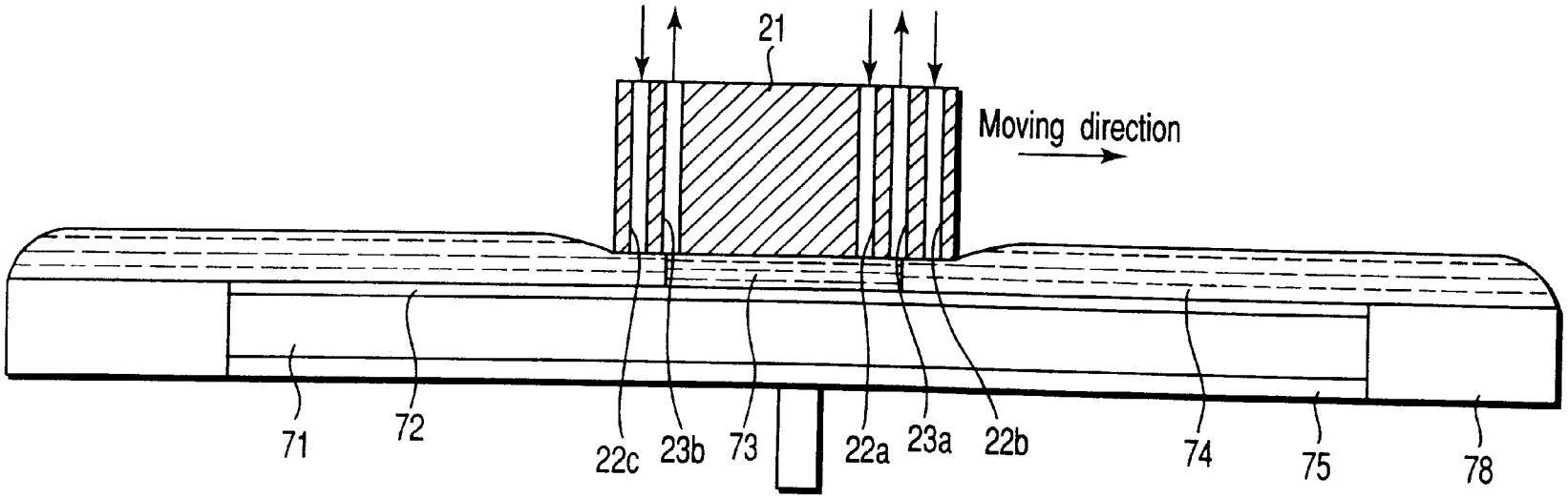
FIG. 7 is a view showing a schematic structure of a scan nozzle in a developing apparatus according to a fourth embodiment.

FIG. 7 shows a schematic structure of a substrate processing portion of the developing apparatus according to the fourth embodiment of the present invention. In FIG. 7, like reference numerals are used to designate like structural elements corresponding to those like in FIGS. 3A to 3D and FIG. 4 and any further explanation is omitted for brevity's sake.

In this embodiment, the developing solution outlet 22*a* positioned between the port 22*b* and the port 22*c* is arranged except the middle point of them. In the case of this example, the developing solution outlet 22*a* is positioned in the front half to the middle point in the moving direction. The rinse solution is discharged from both the port 22*b* and the port 22*c*.

As shown in FIG. 7, a wafer 72 is mounted on the surface of the substrate holder 13. The substrate holder 13 is formed of a wafer holding tool 75 having the same diameter as that of the wafer and a liftable auxiliary board 78 surrounding the wafer holding tool 75 and the wafer 71. On the surface of the wafer 71, a light-sensitive thin film 72 is formed. The surface of the auxiliary board 78 is positioned at the same level as the surface of the light sensitive thin film 72. By virtue of this, when the chemical solution is sucked up through the chemical solution inlet 23, a uniform suction force works in the same plane of the wafer.

Figure 8:
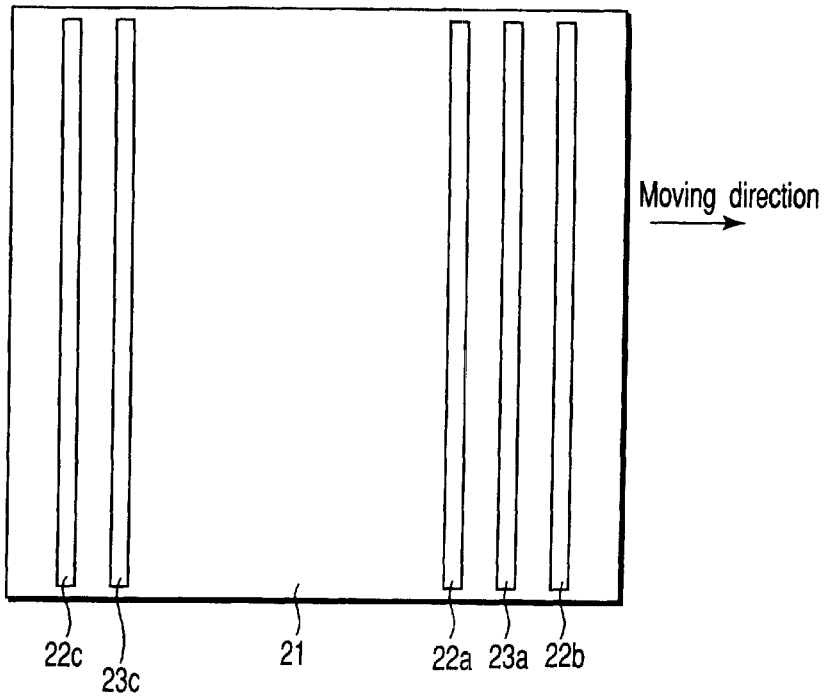
FIG. 8 is a plan view of the scan nozzle of the development apparatus according to the fourth embodiment, as viewed from the bottom.

FIG. 8 shows an enlarged view of individual ports. The distance between the developing solution outlet 22*a* and the chemical solution inlet 23*a* is set at 3 mm. The distance between the developing solution outlet 22*a* and the chemical solution inlet 23*b* is set at 17 mm. Therefore, the developing solution discharged from the developing solution outlet 22*a* forms the flows toward both sides of the chemical solution inlets 23*a* and 23*b*, respectively. The development treatment is performed only within the chemical solution flowing regions.

The temperatures of the chemical solution in the slit nozzle and in the liquid storage within the scan nozzle 21 can be controlled by a heater. The distance between the lower surface of the scan nozzle 21 and the light sensitive thin film 72 is set at about 100 $\mu$m. The scan nozzle 21 has rinse solution outlets 22*b* and 22*c*, so that the periphery of the region formed of the flows of the developing solution 73 can be covered with the rinse solution 74.

A nozzle control system (not shown) controls a developing solution discharge amount, developing solution discharge time, the suction flow amount, suction time, rinse solution discharge amount, discharge time, scan nozzle moving velocity, and temperature of a heater within the scan nozzle.

Now, a method for supplying the developing solution onto the wafer will be explained more specifically. A wafer 71 is formed of an underlying film to be processed and the light sensitive thin film 72 such as a resist (0.4 $\mu$m thick) formed on the underlying film. The wafer 71 is exposed to light via a chrome mask by a KrF excimer stepper to form a latent image on the light sensitive thin film 72. The wafer 71 is held horizontally by the wafer holding tool 75. The scan nozzle 21 capable of supplying a liquid over the entire wafer surface is moved to an initial position above an edge of the wafer. As the developing solution 73, AD-10 (manufactured by Tama Chemical: normality: 0.27) was used. The amounts of the chemical solutions sucked up through the chemical inlets 23*a* and 23*b* are separately adjusted such that the flow rate of the developing solution flowing between the developing solution outlet 22*a* and the chemical solution inlet 23*a* becomes equal to the flow rate of the developing solution 73 flowing between the developing solution outlet 22*a* and the chemical solution inlet 23*b*. The dissolution speed of the exposed light sensitive thin film 72 in the developing solution 73 is 0.05 $\mu$m/sec. Since the thickness of the light-sensitive thin film is 0.4 $\mu$m, the light-sensitive thin film is dissolved in 8 seconds. As a result, the underlying film is exposed.

Figure 9:
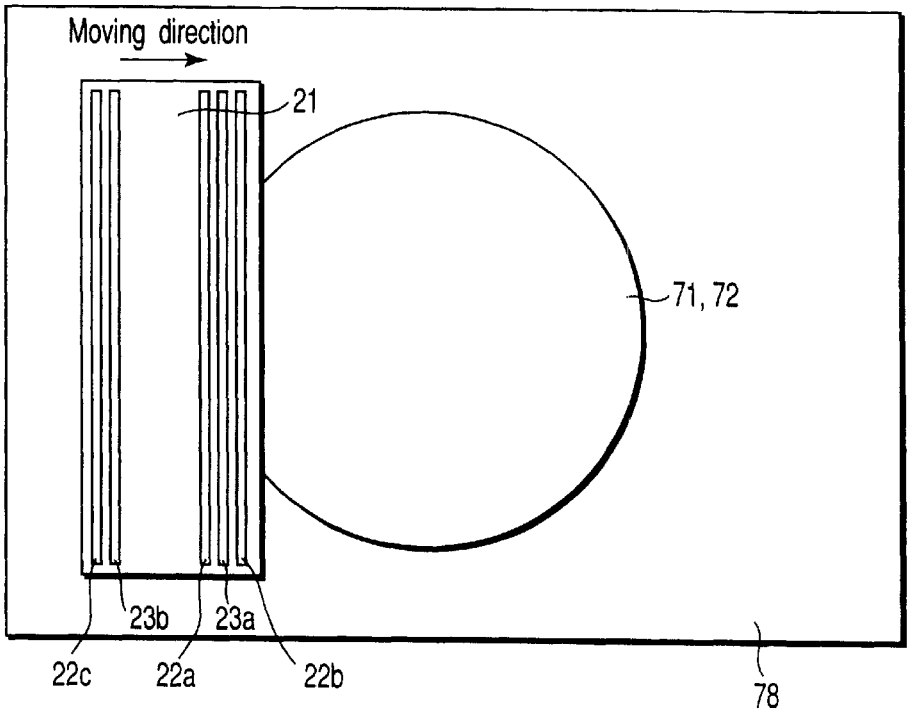
FIG. 9 is a plan view showing a developing step by use of the scan nozzle shown in FIG. 7.

Now, a developing method by the scan nozzle shown in FIG. 7 will be explained with reference to FIG. 9. FIG. 9 is a plan view showing a developing step by using the scan nozzle shown in FIG. 7.

In the first place, the wafer 71 was held by the wafer holding tool 75 and the auxiliary board 78 was positioned at the same level as the light-sensitive thin film 72. The scan nozzle 21 was moved to the initial position on the main surface of the wafer 71. Thereafter, the rinse solution was discharged from the rinse solution outlet 22*b* to fill the gap between the auxiliary board 78 and the light sensitive thin film 72, with the rinse solution 72. The scan nozzle 21 was moved above the edge proton of the main surface of the wafer at a speed of 0.5 mm/sec in a scanning manner while keeping the gap at 100 $\mu$m. At the same time, the discharge of the developing solution from the developing solution outlet 22*a* and the suction of the developing solution from the chemical solution inlet 23 were initiated. From the initiation to the termination of the developing process, the rinse solution was always discharged from the rinse solution outlets 22*b* and 22*c*. Since the distance between the chemical solution inlet 23*a* to the chemical solution inlet 23*b* was 20 mm, all points on the wafer were developed substantially in 40 seconds.

In the time course of the development reaction, the light sensitive thin film is dissolved to form a depressed portion. In the depressed portion, a dissolved product produced by the developing reaction and the developing solution reduced in concentration are left. The dissolved product and the diluted developing solution remaining in the depressed portion inhibit the proceeding of the developing reaction and cause the uneven density of the pattern. As a result, the size difference of the pattern occurs. Hereinafter, the dissolved product and the diluted developing solution will be referred to as a "developing inhibiter".

In this embodiment, the developing solution is discharged toward the substrate (wafer) from the developing solution outlet 22*a* at an extremely high speed of about 6 m/sec. Therefore, the dissolved product and the diluted developing solution remaining in the depressed portion are stirred by the force of the developing solution newly discharged from the developing solution outlet 22*a*. By virtue of stirring, the developing inhibitor is stirred out from the depressed portion. The developing inhibitor thus stirred out is sucked up through the chemical solution inlets 23*a* and 23*b* along with the flow of the developing solution and finally removed from the substrate.

The amount of the developing inhibitor increases with the progress of the developing reaction. Therefore, to reduce the dimensional difference due to the uneven density of the pattern, it is necessary to remove the developing inhibitor efficiently or uniformly stir the developing solution in the initial stage of the development. The initial stage of the development used herein is the time-period from the initiation of the development reaction until the underlying substrate surface is exposed after the light-sensitive thin film is dissolved.

Generally, the time required for minimizing the dimensional difference of the pattern due to the uneven density varies depending upon the dissolution characteristics of the resist. There is an experimental fact that if stirring is performed with the discharge force of the developing solution in the initial stage of the development, the dimensional difference due to the uneven density of the pattern can be minimized. From this experimental fact, the developing conditions are set at as follows: the thickness of the resist film: 0.4 $\mu$m, the resist dissolving rate: 0.05 $\mu$m/sec., the distance between the chemical solution inlet 23*a* and the developing solution outlet 22*a*: 3 mm, and the scan speed of the nozzle: 0.5 mm/sec.

The stirring of the developing solution by the discharge force of the developing solution is performed by passing the chemical solution inlet 23*a* over all points above the substrate, followed by passing the developing solution outlet 22*a*, 6 sec (=3[mm]/0.5[mm/sec]) later. Therefore, 6 seconds after the development is initiated, the developing inhibitor is stirred and removed. This means that stirring is started earlier than the time at which the resist of the light exposure portion is dissolved to expose the underlying substrate (about 8 seconds after the initiation). In the case of the resist used herein, it was desirable that the stirring be performed desirably at the aforementioned timing.

After the nozzle crosses over the wafer surface, the substrate was rinsed well and dried to thereby complete the formation of the resist pattern.

As the size of the resist pattern thus formed was checked by CD-SEM, the dimensional differences of discrete lines of 13 mm, line-and-space, and discrete spaces fall within about 4 nm in in-plane average. Since the dimensional difference is about 15 nm in the conventional method, it is apparent that the present invention can reduce the dimensional difference, drastically.

In the case of this embodiment, the distance of the developing solution outlet 22*a* and the chemical solution inlet 23*a* and the distance between the developing solution outlet 22*a* and the chemical solution inlet 23*b* are set at 3 mm and 17 mm, respectively. However, these distances are not limited to these values. Since the optimal values of these distances vary depending upon developing conditions such as the thickness of the film to be processed, dissolution rate, the discharge pressure of the developing solution, and the gap between the nozzle and the substrate, it is desirable that the distances be set appropriately in accordance with the developing conditions.

Furthermore, the time from the initiation of the development (after the chemical solution inlet passes) to the initiation of the stirring varies depending upon the dissolution characteristics. Therefore, it is necessary to set the time appropriately. More specifically, the time may be set by changing the scan velocity, the developing solution discharge amount, or by differing the amounts of the developing solutions sucked by the right and left inlets.

This embodiment describes the example in which the present invention is applied to wafer development. However, the present invention is not limited to the application of the wafer development. For example, the present invention can be applied to wet etching of a wafer, developing, wet-etching, and cleaning of a light sensitive film on a substrate in a photomask manufacturing process of a semiconductor, and developing in a color filter manufacturing process and in a disk (e.g., DVD) processing step.

The present invention is not limited to the aforementioned embodiments and may be modified in various ways within the scope of the gist of the present invention.

In the aforementioned embodiments, a single chemical solution outlet and a single chemical solution inlet are arranged. However, at least two chemical solution outlets and chemical solution inlets may be arranged alternately.

In the embodiments mentioned above, the prewet solution outlet and the rinse solution outlet are integrally arranged in a single scan nozzle. However, the preset solution and the rinse solution may be supplied onto a semiconductor wafer by a spray nozzle separately from the scan nozzle.

Furthermore, a substrate is housed in a depressed portion which is formed in the substrate holder. However, the upper surface of the substrate holder is formed flat and the substrate may be placed on the flat plane. Alternatively, an auxiliary board having the same thickness as that of the substrate may be arranged around the substrate. In this case, it is desirable that the surface of the auxiliary board be processed in the same condition as that of the surface of the substrate to be treated.

Furthermore, the substrate may be held by a vacuum chuck.

Moreover, the present invention may be performed not only in an atmosphere but also in a liquid. Alternatively, the substrate may be treated while the substrate is immersed in a desired liquid.

Further, the present invention is not limited to the developing apparatus and the developing method according to the aforementioned embodiments. The present invention may be applied to all wet processes such as a resist removing process, a native oxidation film (formed on the surface) removing and cleaning process performed in flat panel display and photomask manufacturing processes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for processing a substrate comprising:

a substrate holding mechanism configured to hold the substrate substantially horizontally;

a chemical solution discharge/suction mechanism having a chemical solution discharge/suction portion which has a chemical solution discharge nozzle for discharging a chemical solution from a chemical solution outlet opposed to the substrate, two chemical solution suction nozzles connected to two chemical solution inlets which are arranged on the same plane with the chemical solution outlet and arranged to sandwich the chemical solution outlet, said two chemical solution suction nozzles sucking a chemical solution on the substrate from the chemical solution inlets, and members each arranged between the chemical solution discharge nozzle and each of the two chemical solution suction nozzles, the bottom surface of said members being provided on the same plane with the chemical solution outlet and the two chemical solution inlets;

a chemical solution supply/suction system configured to supply the chemical solution to said chemical solution discharge/suction mechanism simultaneously with sucking the chemical solution by the chemical solution supply/suction mechanism; and a moving mechanism configured to horizontally move the chemical solution discharge/suction portion relative to the substrate in a direction along which said two chemical solution inlets and said chemical solution outlet are arranged.

2. The apparatus for processing a substrate according to claim 1, wherein said chemical solution outlet is arranged in a position except a middle point of said two chemical solution inlets.

3. The apparatus for processing a substrate according to claim 2, wherein said chemical solution outlet is arranged at a front half to the middle point in the moving direction of the chemical solution discharge/suction portion.

4. An apparatus of processing a substrate comprising:

a substrate holding mechanism for holding the substrate substantially horizontally;

a chemical solution discharge/suction mechanism having a chemical solution discharge/suction portion in which at least two chemical solution outlets for discharging a chemical solution onto the substrate and at least two chemical solution inlets for sucking up the chemical solution present on the substrate are arranged alternately; and a chemical solution supply/suction system for supplying the chemical solution to said chemical solution discharge/suction mechanism simultaneously with sucking the chemical solution by the chemical solution supply/suction mechanism.

5. The apparatus for processing a substrate according to claim 4, wherein, the apparatus further comprising a moving mechanism for horizontally moving the chemical solution discharge/inlet relative to the substrate.

6. The apparatus for processing a substrate according to claim 5, wherein, in said chemical solution discharge/suction portion, a first chemical solution outlet, first chemical solution inlet, a second chemical solution outlet, second chemical solution inlet and a third chemical solution inlet are sequentially arranged in the direction along which the chemical solution discharge/suction portion horizontally moves forward relative to the substrate.

7. The apparatus for processing a substrate according to claim 6, wherein said second chemical solution outlet is arranged in a position except a middle point of two said chemical solution inlets.

8. The apparatus for processing a substrate according to claim 7, wherein said second chemical solution outlet is arranged at a front half to the middle point in the moving direction of the chemical solution discharge/suction portion.

9. The apparatus for processing a substrate according to claim 4, further comprising:

a gap measuring mechanism for measuring a distance between said chemical solution discharge/suction portion and a surface of the substrate to be treated;

and a gap adjusting mechanism for keeping the distance obtained by the gap measuring mechanism at a predetermined value.

10. The apparatus for processing a substrate according to claim 4, wherein said substrate holding mechanism is a vacuum chuck.

11. A substrate processing method for processing a surface of a substrate with a chemical solution comprising:

discharging the chemical solution onto the substrate whose surface to be treated is horizontally held, continuously through a chemical solution outlet of a chemical solution discharge/suction portion; and simultaneously sucking up the chemical solution on the surface to be treated continuously through two chemical solution inlets arranged to sandwich the chemical solution outlet in said chemical solution discharge/suction portion, while said chemical solution discharge/suction portion is horizontally moved relative to the substrate in a direction along which said two chemical solution inlets and said chemical solution outlet are arranged, wherein a fresh chemical solution is always supplied to a gap between the chemical solution discharge/suction portion and the surface to be treated and in the region between said chemical solution outlet and the chemical solution inlets.

12. The substrate processing method according to claim 11, wherein said chemical solution inlet is provided on both sides of the chemical solution outlet and the chemical solution discharged from said chemical solution outlet is sucked up through the chemical solution inlet provided on both sides of the chemical solution outlet.

13. The substrate processing method according to claim 12, wherein a period A from the time at which the chemical solution inlet arranged at a front half in the moving direction of the chemical solution discharge/suction portion passes a point of the substrate until the chemical solution outlet passes the point differs from a period B from the time at which said chemical solution outlet passes the point until the chemical solution inlet arranged at a rear half in the moving direction of the chemical solution discharge/suction portion passes the point.

14. The substrate processing method according to claim 13, wherein the period A is set to be shorter than the period B.

15. The substrate processing method according to claim 13, wherein a developing solution or an etching solution is used as said chemical solution.

16. The substrate processing method according to claim 13, wherein the period A is shorter than the period from the initiation of dissolution of a film to be treated until an underlying surface of the substrate is exposed.

17. The substrate processing method according to claim 11, wherein before the surface of the substrate to be treated is treated with the chemical solution, the surface is reformed.

18. A substrate processing method for processing a surface of a substrate with a chemical solution comprising:

arranging a chemical solution discharge/suction portion having at least two chemical solution outlets for discharging the chemical solution and at least two chemical solution inlets alternately arranged, on the substrate whose surface to be treated is held substantially horizontally;

discharging the chemical solution continuously onto the substrate to be treated from the chemical solution outlets; and simultaneously sucking up the chemical solution on the surface to be treated continuously through the chemical solution inlets, while horizontally moving the chemical solution discharge/suction portion relative to the substrate, thereby treating the surface to be treated with the chemical solution, wherein a fresh chemical solution is always supplied to a gap between the chemical solution discharge/suction portion and the substrate and in the region between each of the chemical solution outlets and each of the chemical solution inlets.

19. The substrate processing method according to claim 18, wherein, in said chemical solution discharge/suction portion, a first chemical solution outlet, one of the chemical solution inlets, a second chemical solution outlet, one of the chemical solution inlets and a third chemical solution inlet are sequentially arranged in the direction along which the chemical solution discharge/suction portion horizontally moves forward relative to the substrate.

20. The substrate processing method according to claim 19, wherein a period A from the time at which the chemical solution inlet arranged at a front half in the moving direction of the chemical solution discharge/suction portion passes a point of the substrate until the second chemical solution outlet passes the point differs from a period B from the time at which the second chemical solution outlet passes the point until the chemical solution inlet arranged at a rear half in the moving direction of the chemical solution discharge/suction portion passes the point.

21. The substrate processing method according to claim 20, wherein the period A is set to be shorter than the period B.

22. The substrate processing method according to claim 20, wherein a developing solution or an etching solution is used as said chemical solution.

23. The substrate processing method according to claim 20, wherein the period A is shorter than the period from the initiation of dissolution of a film to be treated until an underlying surface of the substrate is exposed.

* * * * *